US008186810B2

(12) United States Patent
Akahane

(10) Patent No.: US 8,186,810 B2
(45) Date of Patent: May 29, 2012

(54) LIQUID EJECTING HEAD WITH HEATER FOR HEATING INK

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 12/503,701

(22) Filed: Jul. 15, 2009

(65) Prior Publication Data

US 2010/0013893 A1 Jan. 21, 2010

(30) Foreign Application Priority Data

Jul. 16, 2008 (JP) ..... 2008-184455

(51) Int. Cl.
*B41J 2/045* (2006.01)

(52) U.S. Cl. ..... 347/68; 347/62; 347/65

(58) Field of Classification Search ..... 347/6–65, 347/67, 68, 70, 71
See application file for complete search history.

(56) References Cited

U.S. PATENT DOCUMENTS 6,547,373 B2 * 4/2003 Kitahara ..... 347/68
7,021,749 B2 * 4/2006 Akahane et al. ..... 347/68

FOREIGN PATENT DOCUMENTS

JP 2001-270090 10/2001
JP 2009-051153 3/2009

* cited by examiner

*Primary Examiner* — Juanita D Jackson
(74) *Attorney, Agent, or Firm* — Workman Nydegger

(57) ABSTRACT

A liquid ejecting head includes: a flow path unit including a nozzle forming member with a plurality of nozzle orifices provided in a row, and a flow path forming substrate made of a metal, in which pressure generating chambers in communication with the nozzle orifices are formed; and an actuator unit for giving a pressure fluctuation to the pressure generating chambers, wherein a recess portion is formed in a side of the flow path forming substrate, which faces the nozzle forming member, in a sunken state from a surface of the flow path forming substrate, and a heater is received in the recess portion.

4 Claims, 3 Drawing Sheets

LIQUID EJECTING HEAD WITH HEATER FOR HEATING INK

BACKGROUND

1. Technical Field

The present invention relates to a liquid ejecting head of an ink jet type recording head or the like, and particularly, to a liquid ejecting head for discharging a liquid in a pressure generating chamber out of a nozzle orifice by giving a pressure fluctuation to the pressure generating chamber which is in communication with the nozzle orifice.

2. Related Art

As a liquid ejecting head for discharging (ejecting) a liquid droplet out of a nozzle orifice (one kind of a nozzle) by generating a pressure fluctuation at a liquid in a pressure generating chamber, there are, for example, an ink jet type recording head (hereinafter simply referred to as a recording head) used in an image recording apparatus such as an ink jet type recording apparatus (hereinafter simply referred to as a printer), a color material ejecting head used in manufacturing of a color filter of a liquid crystal display or the like, an electrode material ejecting head used in forming of an electrode of an organic EL (Electro Luminescence) display, FED (Field Emission Display), or the like, a bioorganic matter ejecting head used in manufacturing of a biochip (a biochemical element), and the like.

For example, the above recording head is constituted by mounting a flow path unit in which a series of liquid flow paths extending from a reservoir to a nozzle via a pressure generating chamber are formed, an actuator unit having a pressure generating element capable of varying the volume of a pressure generating chamber, or the like to a head case made of resin. A nozzle plate made of a metal (one kind of a nozzle forming member) in which a nozzle is formed is bonded to the flow path unit.

A liquid to be discharged from the recording head as described above has a viscosity suitable for discharging, for example, such as approximately 4 mPs·s, etc. at a normal temperature according to the kind of a liquid. Since the viscosity of a liquid correlates with a temperature, there is a characteristic that the lower a temperature is, the higher a viscosity is, and the higher a temperature is, the lower a viscosity is. On that account, there has been proposed a recording head provided with a temperature regulating portion for heating (or cooling) a liquid in the case where a recording head designed to be suitable for a viscosity of a liquid used usually is put in low temperature (or high temperature) environment, the case where the recording head discharges a liquid having a high (or low) viscosity, or the like (For example, refer to JP-A-2001-270090).

The temperature regulating portion is formed into a ring shape, and disposed in proximity to a portion of a series of liquid flow paths extending to the nozzle, thereby to directly heat (or cool) a liquid in the liquid flow path. On that account, even the inside of the liquid flow path, a portion not being in proximity to the temperature regulating portion could not heat (or cool) efficiently a liquid to a desired temperature. That is, in the recording head having such a construction, it takes long time until a temperature of a liquid in the liquid flow path is adjusted to a desired temperature, whereby it could not be put to practical use. Further, for efficient heating, it was necessary to dispose the temperature regulating portion in close proximity to the liquid flow path and also, over a long length.

However, if distance between the liquid flow path and the temperature regulating portion becomes more distant, a thermal conductivity is low and also, a direction being transmitted cannot be controlled, whereby, it was not possible to efficiently heat (or cool) a liquid in the liquid flow path. Further, in the case of intending to dispose the temperature regulating portion in close proximity to the liquid flow path and also, over a long length, since there is put limitation on the disposition, there was a fear that the recording head will be made larger, or the degree of freedom of a shape of the recording head will be impaired.

SUMMARY

An advantage of some aspects of the invention is that it provides a liquid ejecting head capable of stably discharging a liquid by efficiently adjusting a viscosity of the liquid.

According to an aspect of the invention, there is provided a liquid ejecting head including:

- a flow path unit including a nozzle forming member with a plurality of nozzle orifices provided in a row, and a flow path forming substrate made of a metal, in which pressure generating chambers in communication with the nozzle orifices are formed; and
- an actuator unit for giving a pressure fluctuation to the pressure generating chambers,
- wherein a recess portion is formed in a side of the flow path forming substrate, which faces the nozzle forming member, in a sunken state from a surface of the flow path forming substrate, and a heater is received in the recess portion.

According to the above construction, since a recess portion is formed in a side of the flow path forming substrate, which faces the nozzle forming member, in a sunken state from a surface of the flow path forming substrate, and a heater is received in the recess portion, the heat of the heater is transmitted to the pressure generating chambers of the flow path forming substrate and the nozzle orifices of the nozzle forming member, so that it is possible to efficiently warm up and feed a liquid regardless to a viscosity or a flow rate of the liquid. Therefore, it is possible to adjust a viscosity of the liquid to that suitable for discharging, thereby to stably discharge the liquid out of the nozzle orifices.

Also, in the above construction, it is preferable that the heater be in contact with the nozzle forming member.

According to the above construction, since the heater is in contact with the nozzle forming member, the heat of the heater is transmitted directly to the nozzle forming member, so that it is possible to efficiently warm up the nozzle orifices. As a result, it is possible to efficiently regulate a viscosity of the liquid immediately before being discharged.

In the above construction, it is preferable to form the recess portion in a state overlapped with the pressure generating chambers with a partition interposed therebetween in a thickness direction of the flow path forming substrate and dispose the heater between the pressure generating chambers and the nozzle forming member.

According to the above construction, since the recess portion is formed in a state overlapped with the pressure generating chambers with a partition interposed therebetween in a thickness direction of the flow path forming substrate and the heater is disposes between the pressure generating chambers and the nozzle forming member, it is possible to heat the pressure generating chambers and the nozzle orifices at the same time. Therefore, it is possible to efficiently adjust a temperature of a liquid.

In the above construction, it is preferable that the recess portion be filled with a filler and the heater be embedded therein.

According to the above construction, since the recess portion is filled with a filler and the heater is embedded therein, the recess portion is filled with the heater and the filler. Therefore, it is possible to restrain leakage of a pressure fluctuation occurred in the pressure generating chamber due to flexure of the partition, whereby poor discharging of the liquid ejecting head can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described with reference to the accompanying drawings. Further, although in the embodiments described below, there are made various limitations as preferred specific examples of the invention, the scope of the invention is not to be limited to these aspects unless there is a statement which intends to particularly limit the invention, in the description below. Moreover, in the embodiments, as an example of a liquid ejecting head, an ink jet type recording head (hereinafter referred to as a "recording head") will be illustrated.

Figure 1:
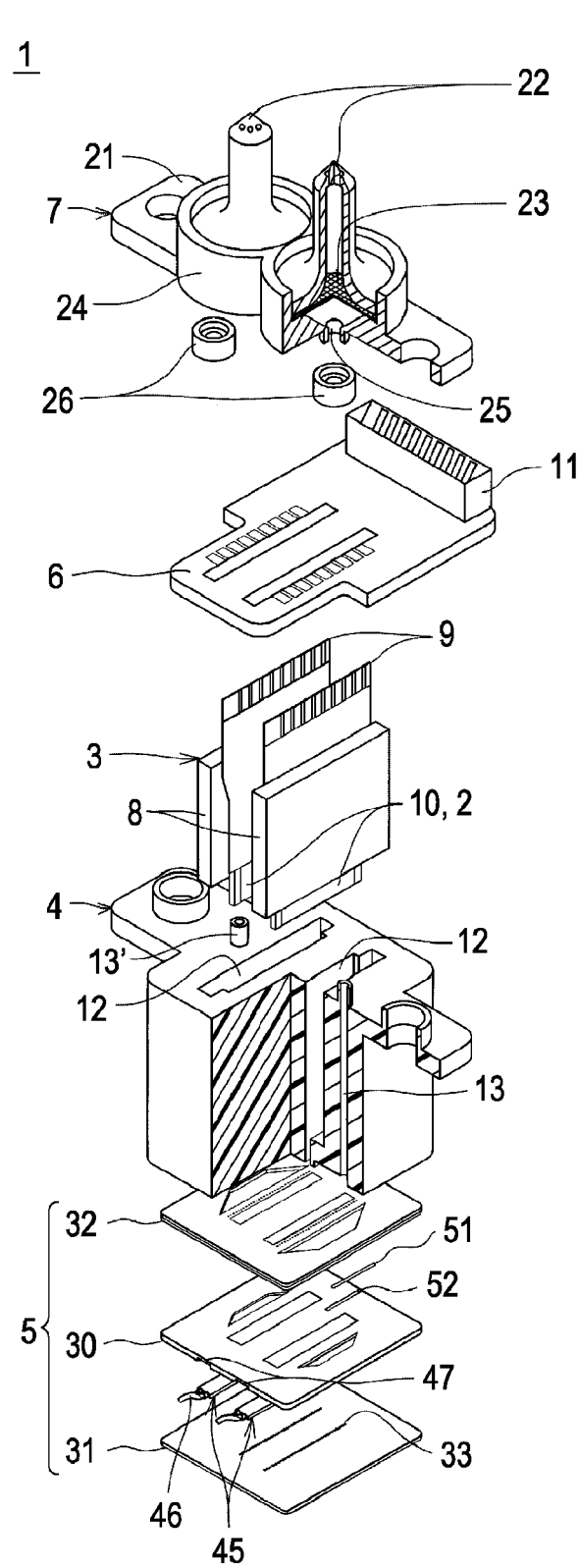
FIG. 1 is an exploded perspective view of a recording head.
Figure 2:
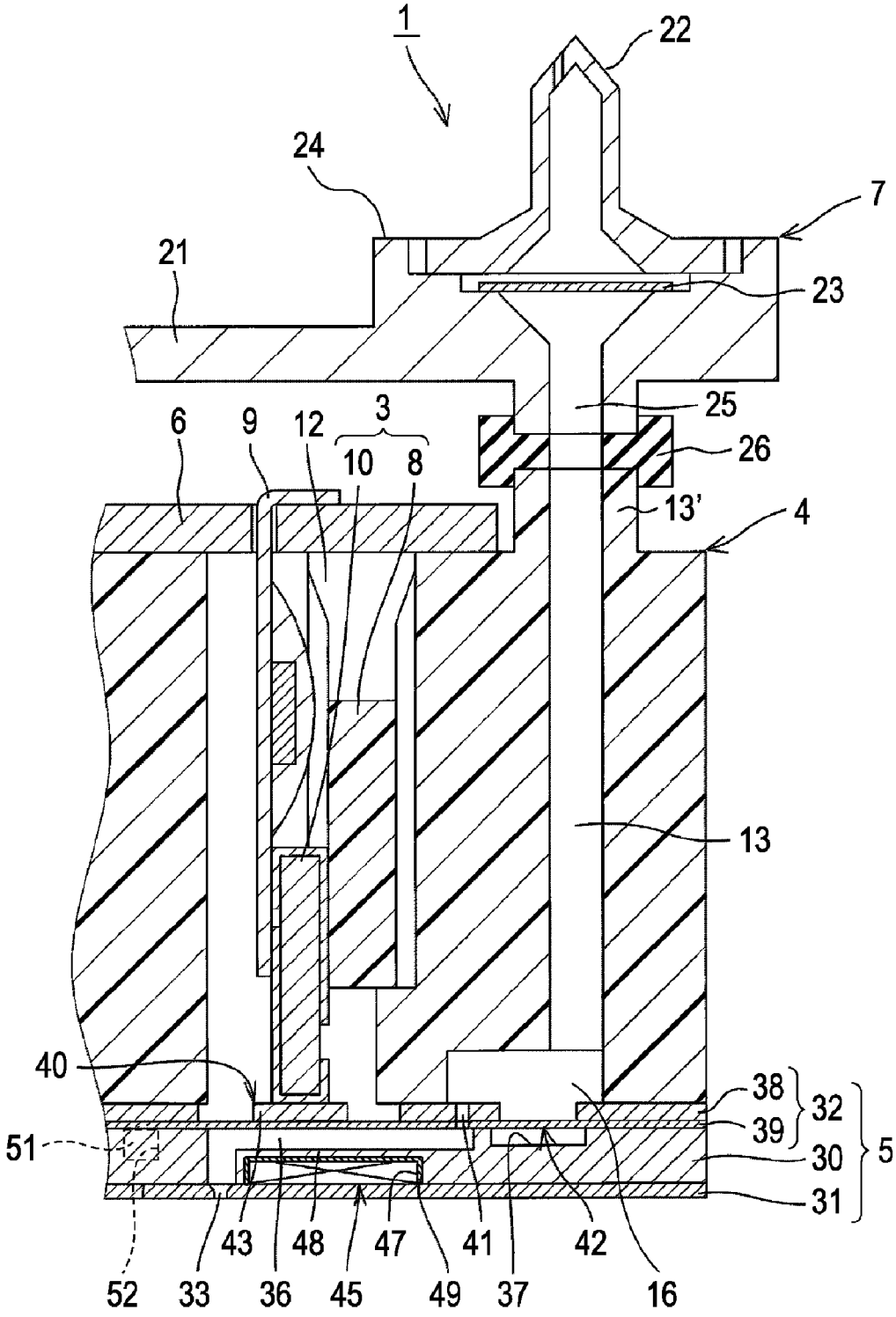
FIG. 2 is a cross-sectional view of the principal portion of the recording head.

FIG. 1 is an exploded perspective view showing an appearance of an ink jet type recording head (hereinafter referred to as a recording head, for brevity) which is one kind of the liquid ejecting head, and FIG. 2 is a cross-sectional view of the principal portion, showing the inner structures of a portion of a flow path unit and a portion of a head case (hereinafter referred to as a case, for brevity). The recording head 1 is generally constituted of an actuator unit 3 having a piezoelectric element group 2; the case 4 for receiving the actuator unit 3; the flow path unit 5 joined to a surface of one side of the case 4; a connecting substrate 6 disposed on a surface of the other side of the case 4, which is the side opposite the flow path unit 5; a supply needle unit 7 mounted above the connecting substrate 6; a heater 45 (one kind of a heating means in the invention) received in the flow path unit 5; and the like.

The actuator unit 3 is constituted of the piezoelectric element group 2 being in the form of the teeth of a comb, a fixing plate 8 to which the base end of the piezoelectric element group 2 is joined, and a flexible cable 9 for supplying a driving signal to the piezoelectric element group 2.

The piezoelectric element group 2 is provided with a plurality of piezoelectric elements 10 formed in a row. Each piezoelectric element 10 is comprised of a pair of dummy elements disposed at both ends of the row, and a plurality of driving elements disposed between the dummy elements. Further, the respective driving elements are separated in the form of the teeth of a comb having an extremely thin width of the order of 50 μm~100 μm and 180 driving elements are provided. Also, the dummy element is sufficiently larger in width than the driving element and has a protection function of protecting the driving elements from a shock or the like and a guide function of positioning the actuator unit 3 at a predetermined position.

The piezoelectric element group 2 has its free end protruded outside the leading end face of the fixing plate 8 with its fixing end bonded on the fixing plate 8. Namely, the piezoelectric element group 2 is supported on the fixing plate 8 in a so-called cantilever state. Further, the free end of the piezoelectric element group 2 is configured by alternately stacking piezoelectric bodies and inner electrodes, and made to extend or contract in a lengthwise direction of the element by applying a potential difference between the opposite electrodes.

The flexible cable 9 is electrically connected to the piezoelectric element group 2 at the side of the fixing end, which is the side opposite the fixing plate 8. Also, on the surface of the flexible cable 9, there are mounted control ICs (not shown) for controlling driving of each piezoelectric element 10, and the like. Further, the fixing plate 8 for supporting the piezoelectric element group 2 is a metallic plate-like member having rigidity capable of taking a reaction force from the piezoelectric element group 2 and uses stainless steel in this embodiment.

The connecting substrate 6 is a wiring substrate on which electric wirings for various signals supplied to the recording head 1 are formed and at the same time, a connector 11 to which a signal cable can be connected is mounted. Further, electric wirings of the flexible cable 9 are connected to the connecting substrate 6 by soldering or the like. Also, the leading end of a signal cable from a control device (not shown) is inserted into the connector 11.

The case 4 is a block-shaped member molded with synthetic resin, for example, such as epoxy-based resin which makes finishing of a shape easy. Further, in the inside of the case 4, there are formed a receiving cavity portion 12 in which the actuator unit 3 is received, and an ink supply path 13 (a liquid supply path) constituting a portion of a flow path for ink (one kind of a liquid in the invention).

At the abutment side of the case 4 against the flow path unit 5, a cavity portion which becomes a common ink chamber (common liquid chamber) 16 is formed.

The ink supply path 13 is formed to pass through the height direction of the case 4 and at its one end, is in communication with the common ink chamber 16. Further, the upper end of the ink supply path 13 is formed in a connecting port 13' provided to protrude from the upper surface of the case 4. Also, the height direction indicates the stacked direction of head components with a nozzle plate 31, which will be described later, as a base (lowest portion).

The supply needle unit 7 is a portion to which an ink cartridge (not shown) is connected, and generally constituted of a needle holder 21, an ink supply needle 22, and a filter 23.

The ink supply needle 22 is a portion inserted into the ink cartridge and introduces ink stored in the ink cartridge into the head. The tip end of the ink supply needle 22 is sharp in a conical shape, and thus configured to be easy to be inserted into the ink cartridge. Also, at the tip end, an ink introducing aperture for allowing flow to communicate between the inside and the outside of the ink supply needle 22 is penetrated.

The needle holder 21 is a member for mounting the ink supply needle 22, and on its surface, a pedestal 24 for fixing the base portion of the ink supply needle 22 is formed. At the bottom surface of the pedestal 24, an ink outlet 25, which passes through the plate thickness direction of the needle holder 21, is formed. Further, the needle holder 21 has flange portions extending laterally.

The filter 23 is a member for obstructing the passage of foreign materials in the ink, such as dust, burrs produced during molding, or the like, constituted of, for example, a dense metal net, and bonded to a filter holding groove formed in the pedestal 24.

Further, the supply needle unit 7 is mounted on the upper surface of the case 4. In the mounted state, the ink outlet 25 of the supply needle unit 7 is in communication with the ink supply path 13 of the case 4 in a liquid-tight state with a packing 26 interposed therebetween.

Next, description will be made about the flow path unit 5. The flow path unit 5 is constituted by disposing the nozzle plate 31 (one kind of a nozzle forming member in the invention) on a surface of one side of a flow path forming substrate 30 and a vibration plate 32 on a surface of the other side, respectively, thereby to form a lamination, and then integrating it by bonding.

The nozzle plate 31 is a plate of stainless steel, in which a plurality of nozzle orifices 33 are formed in a row at a pitch corresponding to dot forming density. In this embodiment, 180 nozzle orifices 33 provided at a pitch of, for example, 180 dpi constitute one nozzle row, and the nozzle rows are provided in parallel (in a head main scanning direction) according to the kind of ink.

The flow path forming substrate 30 is a plate-like member in which a cavity portion becoming a pressure generating chamber 36 is formed in a plurality of numbers in a configuration divided by partitions, in a corresponding relation to the respective nozzle orifices 33. The pressure generating chamber 36 is formed as a chamber elongated in a direction at right angles to a direction of the row of the nozzle orifices 33 (a nozzle row direction). Also, in the flow path forming substrate 30, there is formed a relief recess portion 37 becoming an operating space of a compliance portion 42, which will be described later, in the common ink chamber 16. Although a substrate of a metal such as stainless steel or nickel, or the like is preferably used for the flow path forming substrate 30, in this embodiment, the substrate is manufactured by press-working a stainless substrate.

The vibration plate 32 is a plate material of a two-layer structure comprised of a support plate 38 and an elastic body film 39, as shown in FIG. 2. In this embodiment, a stainless plate is used as the support plate 38, and a stainless film (one kind of a metal foil) is used as the elastic body film 39. As the elastic body film 39, a material other than the stainless film, for example, a resin film such as PPS (polyphenylene sulfide) may also be used. That is, in this case, the vibration plate 32 is of a two-layer structure of a metal plate and a resin film.

In the vibration plate 32, there are provided diaphragm portions 40, ink inlets 41, and the compliance portion 42. As shown in FIG. 2, the diaphragm portions 40 have a function of sealing the opening faces of the pressure generating chambers 36 of the flow path forming substrate 30 and are arranged in a row in the row direction of the piezoelectric elements in a corresponding relation to each pressure generating chamber 36. The diaphragm portions 40 are constituted of only the elastic body film 39 by annularly thinning the portions of the vibration plate corresponding to the pressure generating chambers 36, and in the annular portions, there are formed island portions 43, to each of which the leading end of the piezoelectric element 10 is bonded.

The ink inlet 41 is a hole for allowing flow communication between the pressure generating chamber 36 and the common ink chamber 16 and passes through the plate thickness direction of the vibration plate 32. The ink inlet 41 is also formed every pressure generating chamber 36, similarly to the diaphragm portion 40.

The compliance portion 42 is a portion which partitions a portion of the common ink chamber 16. Namely, the compliance portion 42 seals the opening face of one side of a cavity portion which becomes the common ink chamber 16. The compliance portion 42 is also constituted of the elastic body film 39.

In the vibration plate 32, when the piezoelectric element 10 is driven, thereby extending in its lengthwise direction, the island portion 43 is pushed toward the pressure generating chamber 36, so that the portion of the elastic body film 39 in the periphery of the island portion 43 deforms, thereby to contract the pressure generating chamber 36. On the other hand, when the piezoelectric element 10 contracts in its lengthwise direction, the pressure generating chamber 36 expands by elasticity of the elastic body film 39.

Also, since an ink pressure in the pressure generating chamber 36 is changed by control of expansion or contraction of the pressure generating chamber 36, an ink droplet (liquid droplet) is discharged out of the nozzle orifice 33.

Next, description will be made about the heater 45 which is a heating means provided in the flow path forming substrate 30. The heater 45 showing in this embodiment is of a flat plate shape, a so-called cartridge heater made by sealing a heating element such as a ceramic or a electric heating wire by a metal case, and generates heat by flowing an electric current to a lead line 46. The heater 45 is received in a recess portion 47 which is formed in the abutment surface of the flow path forming substrate 30 against the nozzle plate 31 in a sunken state from the surface.

The recess portion 47 is provided in a groove shape along the row direction of the pressure generating chambers 36, and also, in a state overlapped with the pressure generating chambers 36 with a partition 48 interposed therebetween in a thickness direction of the flow path forming substrate 30. The partition 48 is formed in the form of a thin plate separating the pressure generating chambers 36 and the recess portion 47. Therefore, the recess portion 47 is positioned between each pressure generating chamber 36 and the nozzle plate 31, as shown in FIG. 2. Further, since the recess portion 47 is formed to be of a size slightly larger than that of the heater 45, the heater 45 as a whole can be surely received in the recess portion.

The recess portion 47 thus formed is filled with a filler 49 before a process of bonding the flow path forming substrate 30 and the nozzle plate 31, and thereafter, the heater 45 is pushed into the recess portion 47 so as to be embedded therein. Then, the recess portion 47 is full of the filler 49 and the heater 45, and at the same time, the surface (exposure surface) of the heater 45 facing the nozzle plate 31 is positioned in a state in accordance with the abutment surface of the flow path forming substrate 30 against the nozzle plate 31. In this state, when the flow path forming substrate 30 and the nozzle plate 31 are bonded to each other to be fixed, the heater 45 is in a close contact with the nozzle plate 31.

Further, it is also possible that after the heater 45 is loaded in the recess portion 47, the filler 49 is charged in such a manner that it fills up a gap. In this way, if the filler 49 fills up a gap between the recess portion 47 and the heater 45, the strength of the partition 48 is reinforced after hardening, so that flexure of the partition can be prevented.

Then, if an electric current is applied to the heater 45 received in the recess portion 47, the heater 45 generates heat and the heat is transmitted from the flow path forming substrate 30 to the pressure generating chambers 36 via the partition 48, so that the ink in the pressure generating chambers 36 are heated. Further, since the surface (exposure surface) of the heater 45 facing the nozzle plate 31 is in contact with the nozzle plate 31, heat of the heater 45 is transmitted directly to the nozzle plate 31, so that the ink in the nozzle orifices 33 are heated.

In this state, if the piezoelectric element 10 is driven, since the recess portion 47 is filled with the filler 49, it is possible to prevent leakage of pressure due to flexure of the partition 48 by a pressure fluctuation occurred in the pressure generating chamber 36. Also, the ink warmed up in the pressure generating chamber 36 and the nozzle orifice 33 by the heater 45 is discharged out of the nozzle orifice 33 by a pressure fluctuation in the pressure generating chamber 36. Since the ink droplet is lowered in viscosity by warming-up, the quantity of ink as designed is discharged in a stable state.

Further, in this embodiment, in the flow path forming substrate 30, there is formed a recess portion 52 for receiving a thermocouple 51 as a temperature sensor. The recess portion 52 is provided in the abutment surface of the flow path forming substrate 30 against the vibration plate 32 in a sunken state from the surface and between the rows of the pressure generating chambers 36 belonging to adjacent nozzle rows and extends along a direction of the nozzle row. In the recess portion 52 thus formed, there is adhered and fixed the thermocouple 51 by an adhesive agent, etc.

Further, if in a process of bonding the flow path unit 5, at the same time, the adhesive agent is charged also in the recess portion 52, so that the thermocouple 51 is fixed in the recess portion 52 by adhesion, a process of fixing the thermocouple 51 separately can be omitted.

Further, the thermocouple 51 received in the recess portion 52 measures a temperature of the flow path forming substrate 30, whereby a temperature of the ink in the pressure generating chamber 36 and the nozzle orifice 33 can be measured. Therefore, by adjusting the temperature of the heater 45 on the basis of the measured value, the temperature of ink can be adjusted to the viscosity suitable for discharging. Further, with the recess portion 52 formed to be of a size capable of completely receiving the thermocouple 51 therein, there is no fear that the thermocouple 51 will protrude from the flow path unit 5, whereby it does not become an obstacle even when the surface of the nozzle plate 31 is wiped (swept).

As described above, it is possible that the recording head 1 of the invention transmits the heat of the heater 45 to the flow path forming substrate 30, thereby to heat the ink in the pressure generating chamber 36 and at the same time, transmits the heat directly to the nozzle plate 31, thereby to efficiently heat the ink in the nozzle orifices 33 immediately before being discharged. Therefore, regardless of a viscosity of the ink fed from the ink supply path 13, it is possible to adjust a viscosity of ink to that suitable for discharging, whereby the ink can be stably discharged out of the nozzle orifices 33. As a result, reliability of the liquid ejecting head 1 can be improved.

Figure 3:
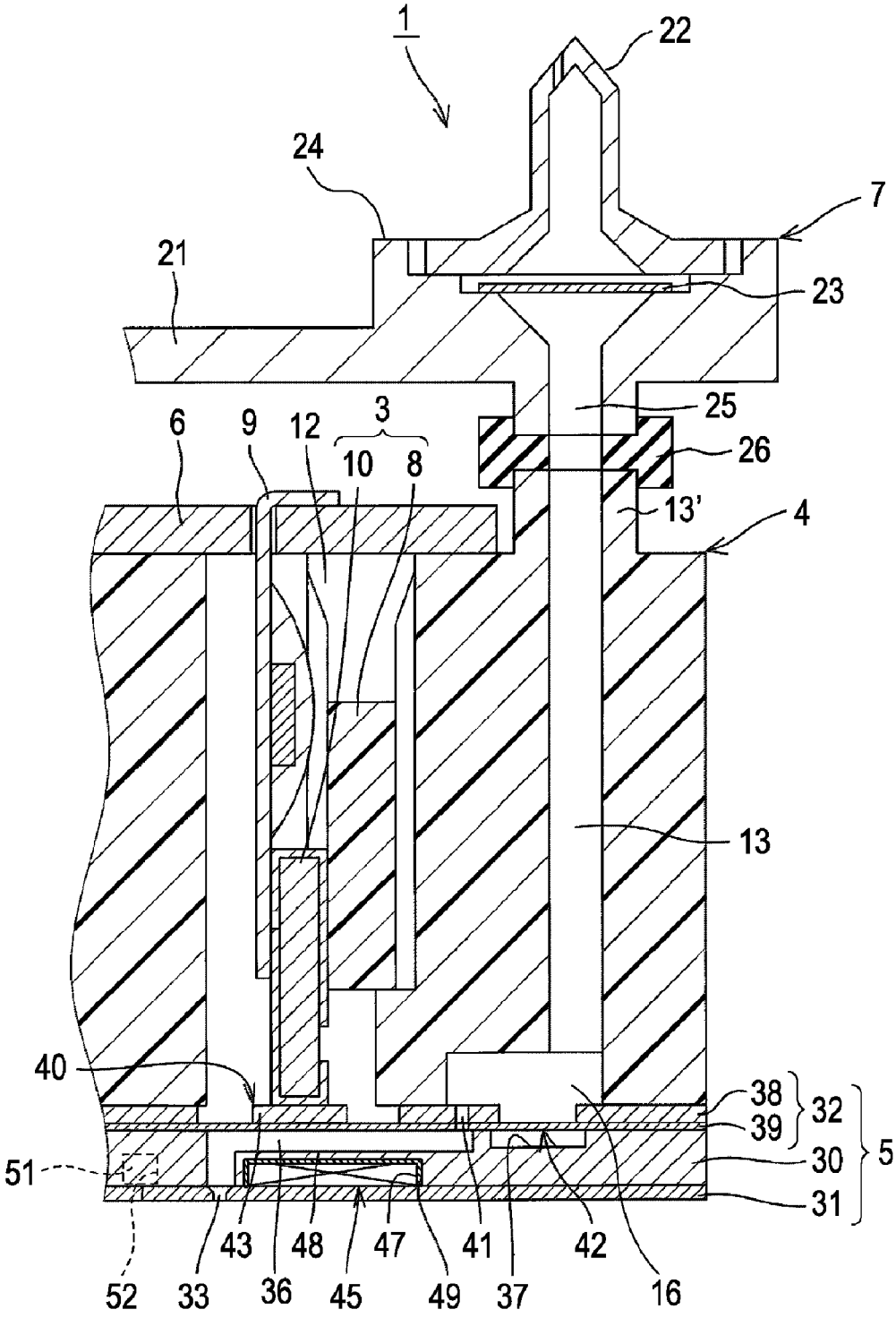
FIG. 3 is a cross-sectional view of the principal portion of a recording head in another embodiment.

However, the invention is not to be limited to each embodiment described above, and various modifications may be made on the basis of the description of the claims. Although in the embodiment above, an example was presented in which the recess portion 52 is formed in the abutment surface of the flow path forming substrate 30 against the vibration plate 32, the invention is not limited to this, but, for example, as shown in FIG. 3, the recess portion 52 may be formed in the abutment surface of the flow path forming substrate 30 against the nozzle plate 31 so that the thermocouple 51 is in contact with the nozzle plate 31. With this construction, since a temperature of the ink in the nozzle orifices 33 immediately before being discharged can be measured by the thermocouple 51 at a close point, the temperature of the heater 45 can be adjusted on the basis of the measured result.

The foregoing description is an example in which the invention is applied to an ink jet type recording head. However, the invention is not to be limited to this. The invention can also be applied to other liquid ejecting heads, for example, such as a color material ejecting head used in manufacturing of a color filter of a liquid crystal display or the like, an electrode material ejecting head used in forming of an electrode of an organic EL (Electro Luminescence) display, FED (Field Emission Display), or the like, and a bioorganic matter ejecting head used in manufacturing of a biochip (a biochemical element).

What is claimed is:

1. A liquid ejecting head comprising:

a flow path unit including a nozzle forming member with a plurality of nozzle orifices provided in a row, and a flow path forming substrate made of a metal, in which pressure generating chambers in communication with the nozzle orifices are formed; and an actuator unit for giving a pressure fluctuation to the pressure generating chambers, wherein a recess portion is formed in a side of the flow path forming substrate, which faces the nozzle forming member, in a sunken state from a surface of the flow path forming substrate, and a heater is received in the recess portion, wherein the recess portion is filled with a filler and the heater is embedded therein.

2. The liquid ejecting head according to claim 1, wherein the heater is in contact with the nozzle forming member.

3. The liquid ejecting head according to claim 1, wherein the recess portion is formed in a state overlapped with the pressure generating chambers with a partition interposed therebetween in a thickness direction of the flow path forming substrate, and the heater is disposed between the pressure generating chambers and the nozzle forming member.

4. A liquid ejecting apparatus provided with the liquid ejecting head according to claim 1.

* * * * *